US006857349B2

(12) United States Patent
Duquet

(10) Patent No.: US 6,857,349 B2
(45) Date of Patent: Feb. 22, 2005

(54) METHOD OF PRODUCING CHAINSAW CHAIN ALLOWING TO INCREASE THE EFFECTIVENESS OF THE WOODCUTTER IN MODIFYING THE CUTTER LINKS AND SOME SAFETY LINKS

(76) Inventor: Germain Duquet, 2580 Rue du Plaza, Suite 405, Sillery, (Quebec) (CA), G1T 1X1

( * ) Notice: Subject to any disclaimer, the term of this patent is extended or adjusted under 35 U.S.C. 154(b) by 0 days.

(21) Appl. No.: 10/036,892

(22) Filed: Jan. 4, 2002

(65) Prior Publication Data

US 2003/0126952 A1 Jul. 10, 2003

(51) Int. Cl.[7] ..... B27B 33/14
(52) U.S. Cl. ..... 83/834; 83/833
(58) Field of Search ..... 76/112; 83/830, 83/832, 833, 834; 30/381; D8/65

(56) References Cited

U.S. PATENT DOCUMENTS

| | | | | | |
|---|---|---|---|---|---|
| 3,696,692 | A | * | 10/1972 | Baranowski et al. | 76/112 |
| 4,088,047 | A | * | 5/1978 | Ratz et al. | 76/112 |
| 4,414,876 | A | * | 11/1983 | Loigerot | 83/830 |
| 4,562,762 | A | * | 1/1986 | Dubler | 83/834 |
| 4,567,803 | A | * | 2/1986 | Anderson | 83/833 |
| 4,750,395 | A | * | 6/1988 | Doiron | 83/834 |
| 4,756,221 | A | * | 7/1988 | Nitschmann et al. | 83/833 |
| 6,058,825 | A | * | 5/2000 | Harfst | 83/834 |
| 6,308,606 | B1 | * | 10/2001 | Buchholtz et al. | 83/834 |

* cited by examiner

*Primary Examiner*—Hwei-Siu Payer

(57) ABSTRACT

A safety saw chain for chain saw and more particularly to the configuration of drive links and cutter links so as to get a high cutting power, to decrease the vibration, kickback, and the friction of the saw chain on the guide bar.

2 Claims, 7 Drawing Sheets

METHOD OF PRODUCING CHAINSAW CHAIN ALLOWING TO INCREASE THE EFFECTIVENESS OF THE WOODCUTTER IN MODIFYING THE CUTTER LINKS AND SOME SAFETY LINKS

BACKGROUND OF THE INVENTION

1. Field of the Invention

The present invention relates to a safety saw chain for chain saw and more particularly to the configuration of drive links and cutter links so as to get a high cutting power, to decrease the vibration, kickback, and the friction of the saw chain on the guide bar.

2. Description of the Related Art

A search of prior art records has unveiled the following patents:

1. No CA 1,195,211 issued in 1985 to Landwehr;
2. No CA 627238 issued in 1961 to August;
3. No CA 651448 issued in 1962 to August;
4. No U.S. Pat. No. 4,088,047 issued in 1978 to Ratz and al.;
5. No U.S. Pat. No. 4,567,803 issued in 1986 to Anderson;
6. No U.S. Pat. No. 4,756,221 issued in 1988 to Nitschmann and al.; and
7. No U.S. Pat. No. 4,414,876 issued in 1983 to Loigerot.

The patent to Ratz is probably the most relevant. As can be seen, the patent to Ratz shows a method of producing cutting teeth for a chain saw each of which has a base body and a tooth roof, and in which the base body is cranked along a substantially sharp edge relative to tooth roof.

The gist of the invention is therefore to provide a saw chain with a simple configuration so as to get a high cutting power, to decrease the vibration, kickback, and the friction of the saw chain on the guide bar.

SUMMARY OF THE INVENTION

The present invention describes a safety saw chain for chain saw including cutter links and drive links interconnected together by connector links and rivet. Each cutter link includes a cutting tooth portion formed with a top plate portion, a side plate portion and a front portion defining a side furrow enabling the cutter link to keep its angle of penetration because of the sharp edges of cutting tooth portion facilitating to go through the wood. The cutter top plate portion is bent over at an angle relative to side plate portion. The rear region of cutting tooth portion is lightly curved inwardly of the cutter link.

The depth gauge link is formed with the body portion, cutter portion and rocker portion. The rocker portion includes an upper surface provided with two transverse grooves enabling to free the saw-dust of the saw chain, and a longitudinal furrow reducing the side movement of the cutter link by it keeping in a longitudinal direction for facilitating a wood-cutting more deep.

The thickness of rocker on the side surface decreases the force of impact on the rocker portion, and its angle lightly inclined inwardly of the cutter link decreases the side movements of the cutter link and the retreat effect, by example the cutting of branches close to the trunk.

The side cutting edge of rocker is defined by an oblique angle decreasing the vertical and longitudinal vibration of the saw chain, and the retreat effect caused by the friction of the saw chain in a kerf cut.

Each drive link having an upper surface lightly rounded along its length, is configured so as to get a better evacuation of the saw-dust and effectiveness of the wood-cutting.

Advantages of the Invention:

Maintenance less;

More safe;

Increase the chain, chainsaw and guide bar durability;

Increase the sharpening durability;

Increase the woodcutter;

Diminution of the gasoline and oil consumption;

Diminution of the vibration and kickback;

Diminution of physique effort;

Diminution of chainsaw derailment; and

Diminution of the rejection of saw-dust twig in the visor.

BRIEF DESCRIPTION OF THE SEVERAL VIEWS OF THE DRAWING(S)

DETAILED DESCRIPTION OF THE INVENTION

Figure 1:
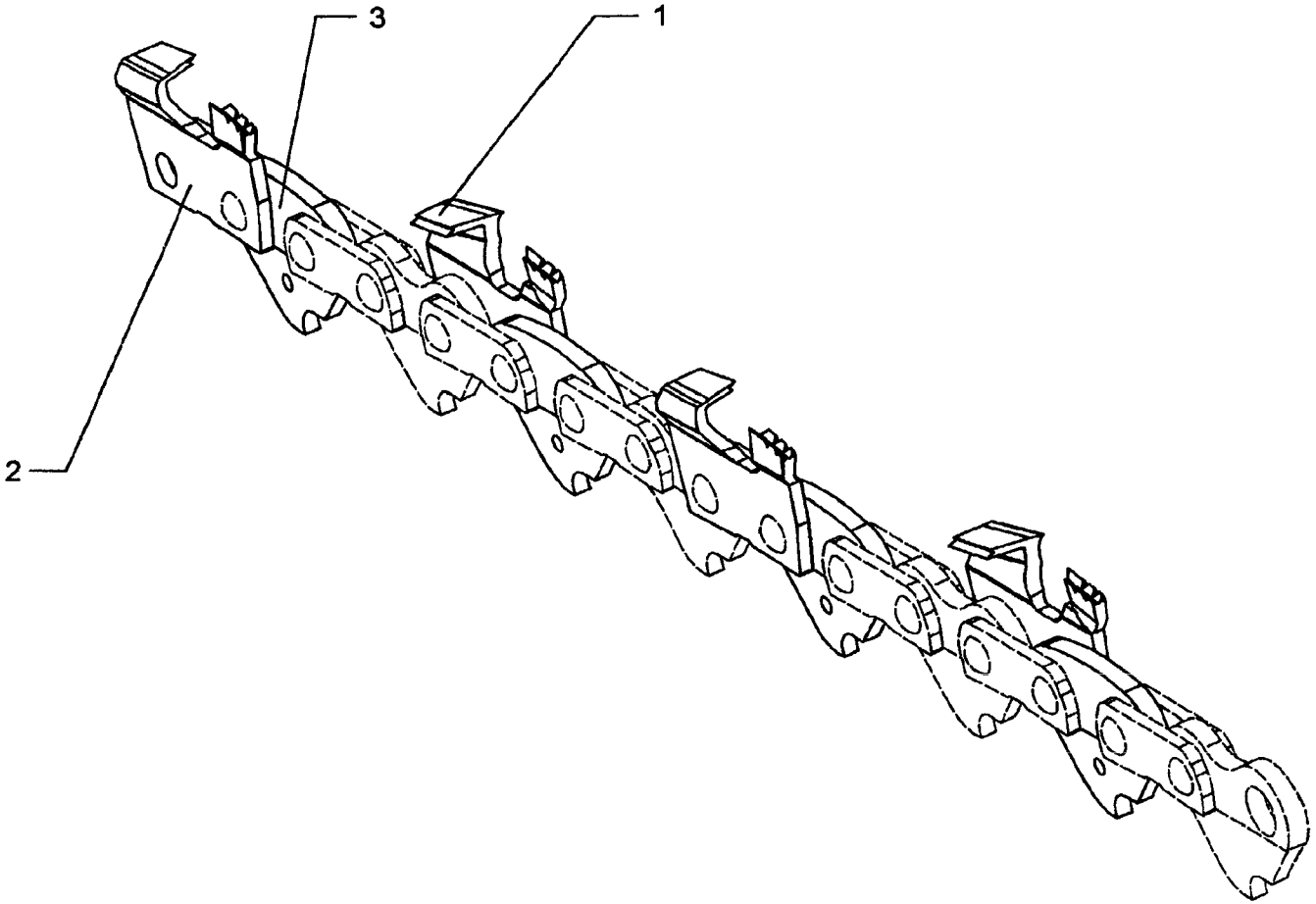
FIG. 1 shows a left side perspective view of a saw chain having drive links and cutter links in accordance with the present invention.
Figure 2:
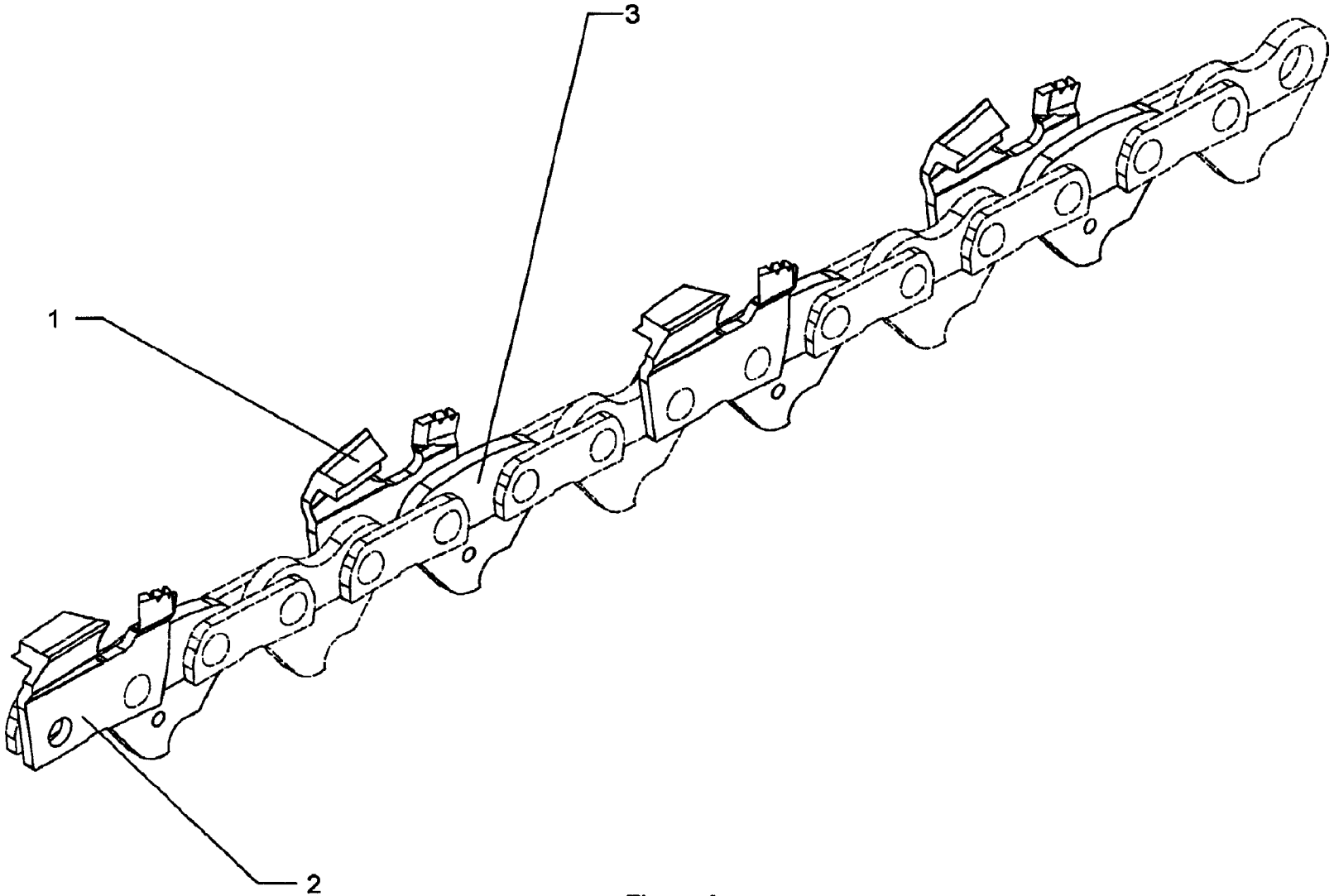
FIG. 2 shows a right side perspective view thereof.
Figure 3:
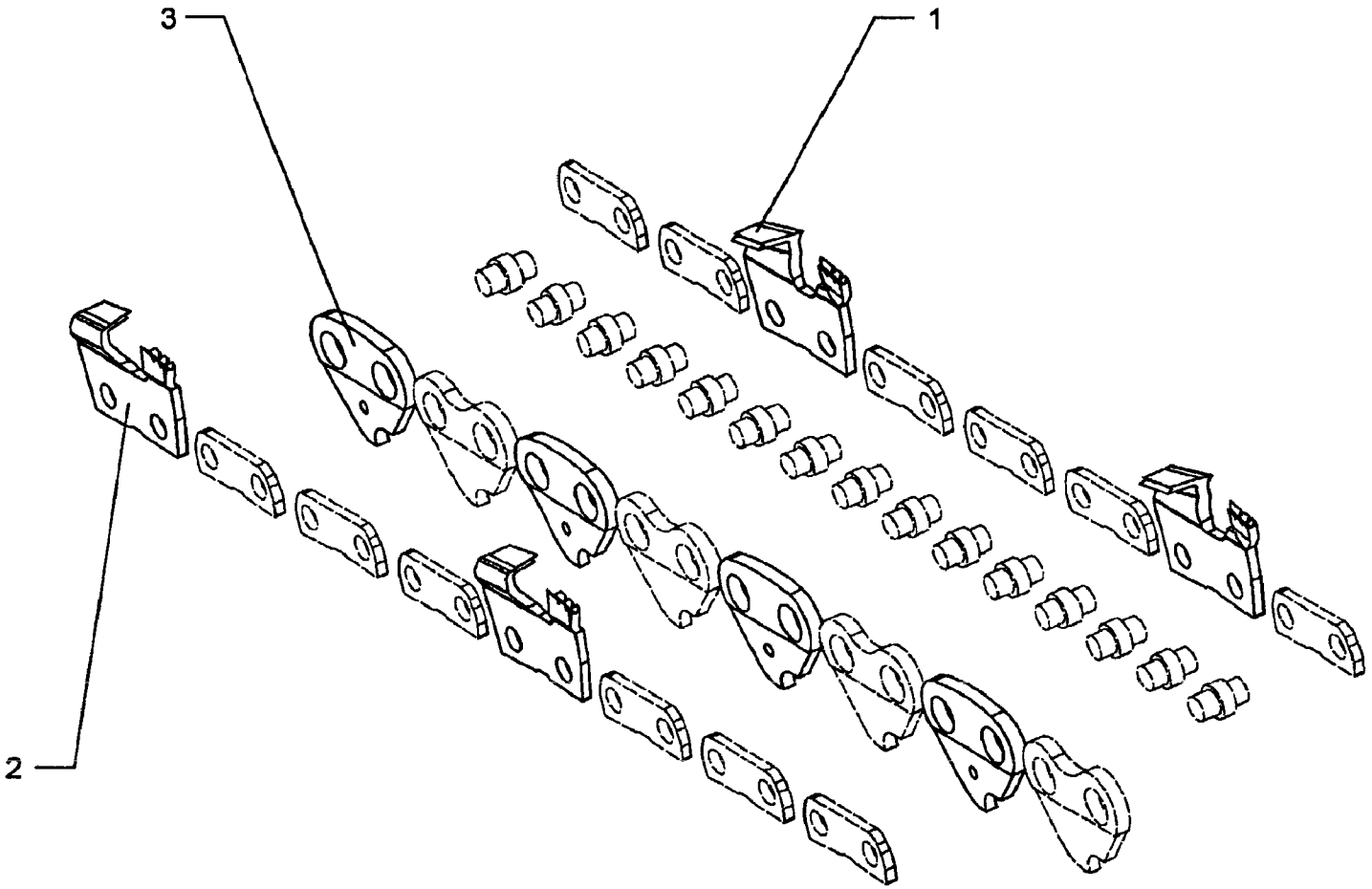
FIG. 3 shows an exploded view thereof.
Figure 4:
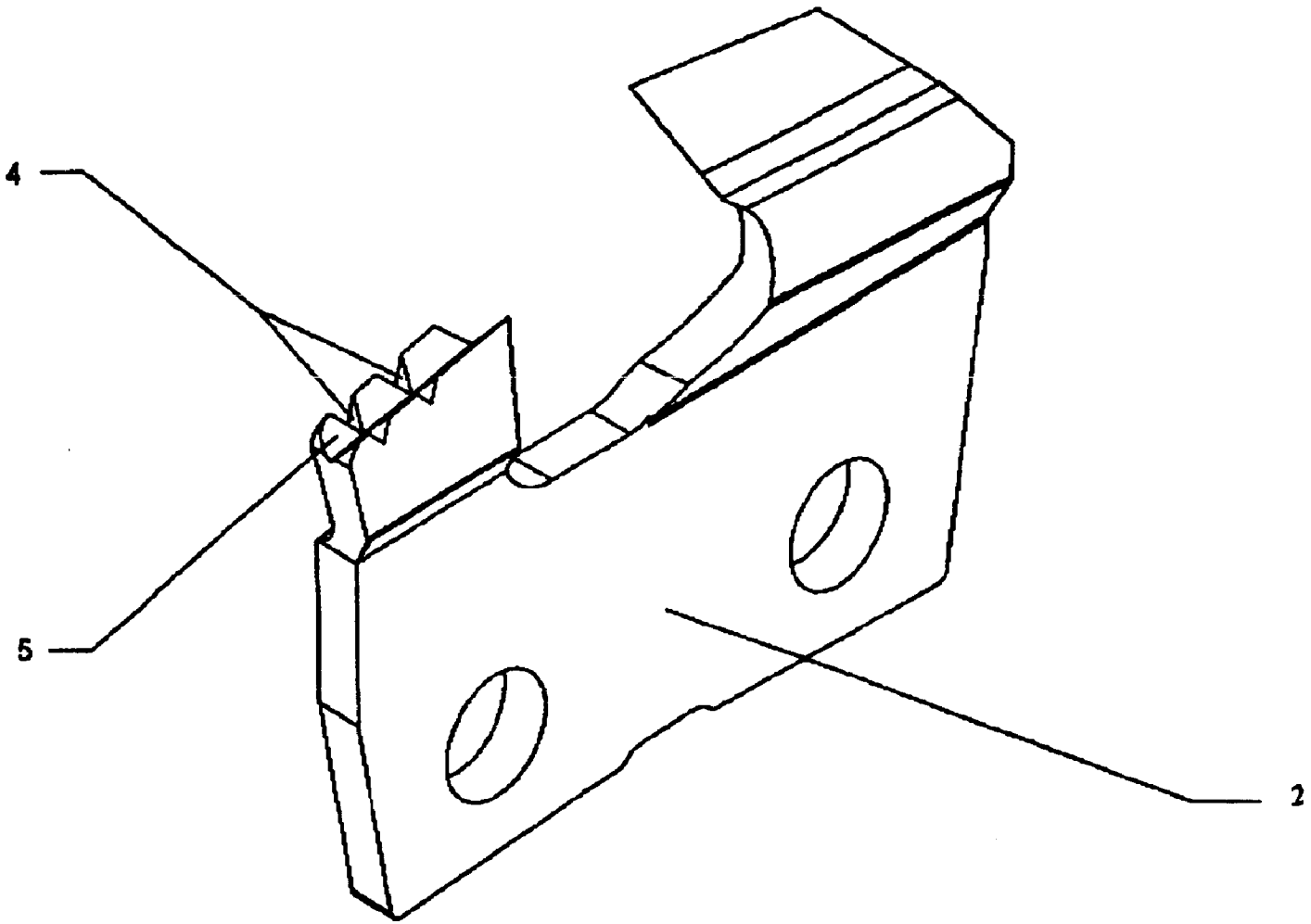
FIG. 4 shows a left side perspective view of a cutter link.
Figure 5:
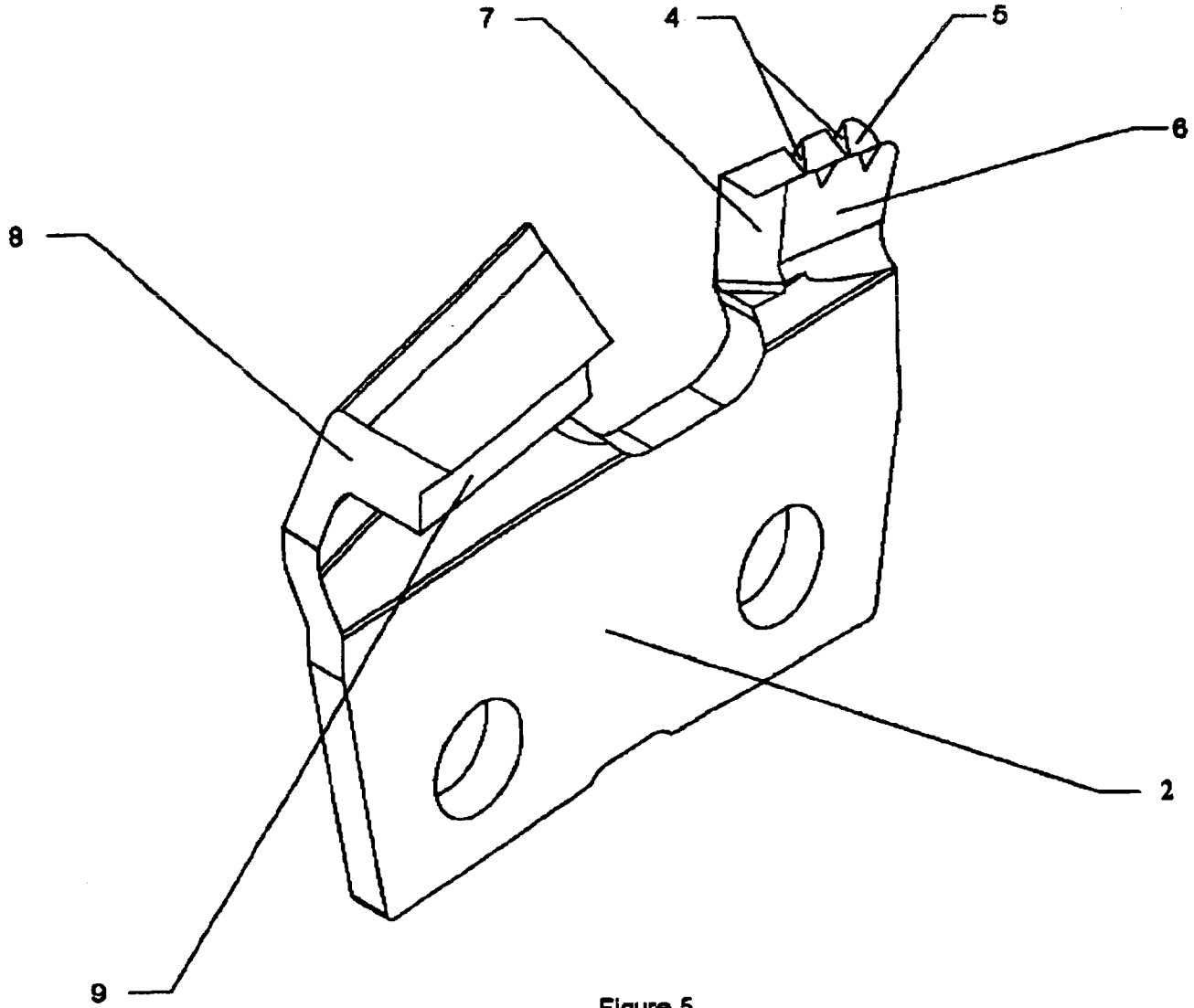
FIG. 5 shows a right side perspective view thereof.
Figure 6:
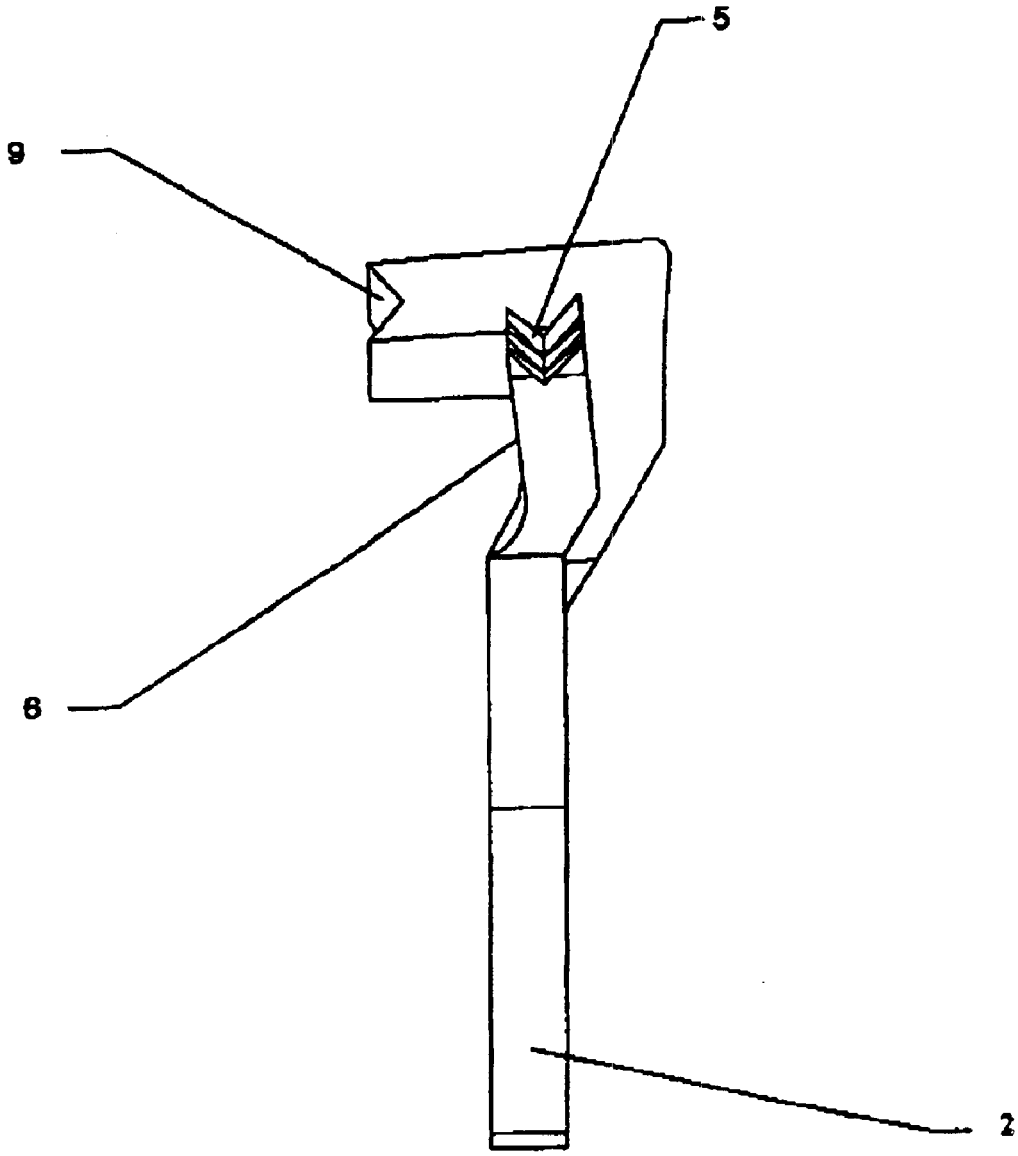
FIG. 6 shows a front view thereof.
Figure 7:
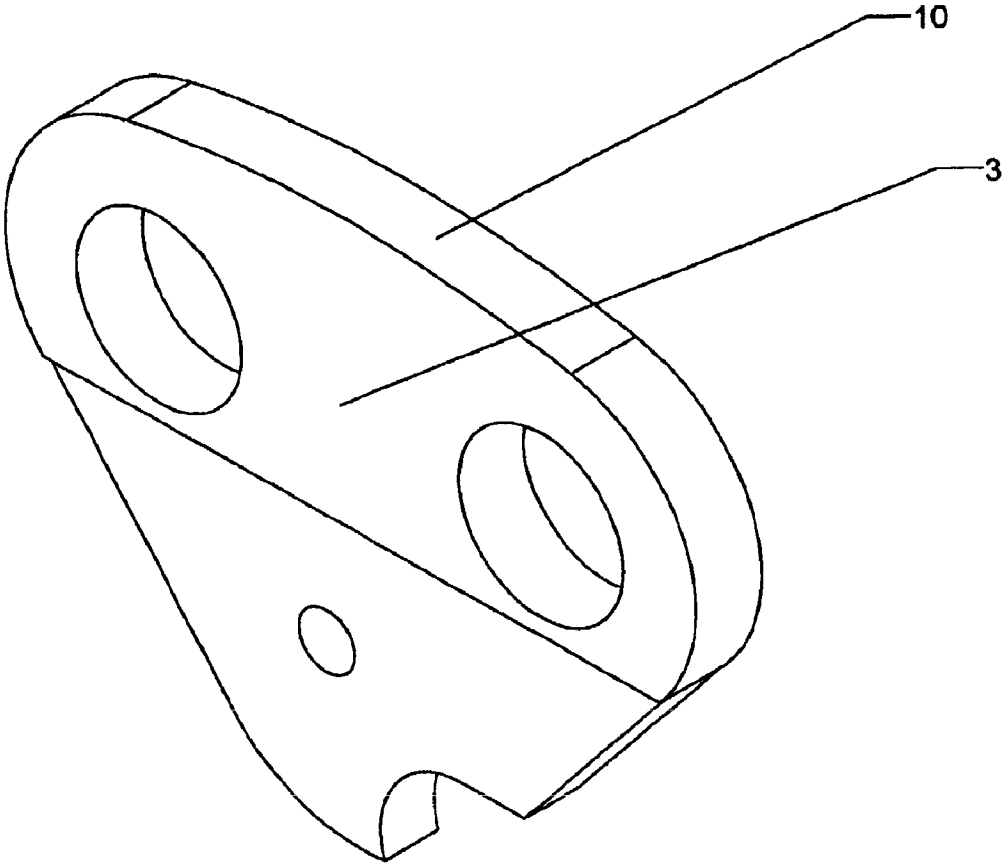
FIG. 7 shows a perspective view of a drive link.

Referring to the drawings, and more particularly to FIGS. 1 to 7, a safety saw chain for chain saw including cutter links (2) and drive links (3) interconnected together by connector links and rivet shown in phantom lines.

Each cutter link (2) includes a cutting tooth portion (1) formed with a top plate portion, a side plate portion (8) and a front portion defining a side furrow (9) enabling the cutter link to keep its angle of penetration because of the sharp edges of cutting tooth portion facilitating to go through the wood.

The cutter top plate portion is bent over at an angle relative to side plate portion (8). The rear region of cutting tooth portion is lightly curved inwardly of the cutter link (2).

The depth gauge link is formed with the body portion, cutter portion and rocker portion. The rocker portion includes an upper surface provided with two transverse grooves (4) enabling to free the saw-dust of the saw chain, and a longitudinal furrow (5) reducing the side movement of the cutter link by it keeping in a longitudinal direction for facilitating a wood-cutting more deep.

The thickness of rocker on the side face (6) decreases the force of impact on the rocker portion, and its angle lightly inclined inwardly of the cutter link decreases the side movements of the cutter link and the retreat effect, by example the cutting of branches close to the trunk.

The side cutting edge (7) of rocker is defined by an oblique angle decreasing the vertical and longitudinal vibration of the saw chain, and the retreat effect caused by the friction of the saw chain in a kerf cut.

Each drive link (3) having an upper surface lightly rounded along its length, is configured so as to get a better evacuation of the saw-dust and effectiveness of the wood-cutting.

Although only a single embodiment of the present invention has been described and illustrated, the present invention is not limited to the features of this embodiment, but includes all variations and modifications within the scope of claims.

Legend:

1: Cutting tooth

2: Cutter link

3: Drive link

4: Grooves of the rocker

5: Longitudinal furrow of the rocker

6: Thinning side face of the rocker

7: Side cutting edge of the rocker

8: Side plate portion of the cutting tooth

9: Side furrow of the cutting tooth

10: Upper surface of the drive link

The embodiments of the invention for which an exclusive property or privilege is claimed, are defined as follows:

1. A saw chain for chain saw comprising cutter links and drive links interconnected together by connector links and rivet, wherein each cutter link includes:

a rocker portion formed with an upper surface provided with two transverse grooves enabling to free the saw-dust of the saw chain, a longitudinal furrow reducing the side movement of the cutter link by it keeping in a longitudinal direction for facilitating a wood-cutting more deep, a thinning side surface for decrease the force of impact on the rocker portion having its angle lightly inclined inwardly of the cutter link for decreasing the side movements of the cutter link and the retreat effect, and a side cutting edge defining an oblique angle for decreasing the vertical and longitudinal vibration of the saw chain, and the retreat effect caused by the friction of the saw chain in a kerf cut.

2. The saw chain as defined in claim 1, wherein each drive link is formed with an upper surface lightly rounded along its length for getting a better evacuation of the saw-dust and effectiveness of the wood-cutting.

* * * * *